United States Patent [19]

Istoshin et al.

[11] 4,155,491

[45] May 22, 1979

[54] ARRANGEMENT FOR TRANSPORTING SOLID MATERIALS FROM THE BOTTOM OF BASINS

[76] Inventors: Stanislav J. Istoshin, Koptevskaya ulitsa, 26, korpus 3, kv. 69; Georgy M. Lezgintsev, Leninsky prospekt, 36, kv. 250; Mikhail A. Belyavsky, ulitsa Butlerova, 10, kv. 81; Evgeny A. Kontar, ulitsa Kropotkina, 9, kv. 2; Nikolai N. Koptyazhin, Matveevskaya ulitsa, 36, korpus 2, kv. 145, all of Moscow, U.S.S.R.

[21] Appl. No.: 838,719

[22] Filed: Oct. 3, 1977

[51] Int. Cl.[2] ..... E02F 7/02

[52] U.S. Cl. ..... 222/371; 37/69; 37/DIG. 8

[58] Field of Search ..... 37/69, 71, 55, DIG. 8; 299/8, 9; 222/4, 135, 371

[56] References Cited

U.S. PATENT DOCUMENTS

| | | | |
|---|---|---|---|
| 364,780 | 6/1887 | Shepard | 37/71 |
| 3,968,579 | 7/1976 | Rossfelder | 37/69 |
| 4,055,006 | 10/1977 | Shibata | 37/69 |

*Primary Examiner*—Clifford D. Crowder

*Attorney, Agent, or Firm*—Lackenbach, Lilling & Siegel

[57] ABSTRACT

The arrangement is mainly designed for transporting solid minerals from the floor of the ocean to a support vessel. The arrangement comprises an endless flexible carrier which is made of interconnected container sections. Each section has two chambers — a load chamber and a float chamber. The arrangement also has means for batched loading of the chambers with solid mineral and compressed gas. During operation of the arrangement, the load chambers are loaded with solid mineral and the float chambers are filled with gas so that the loaded sections of the carrier acquire a positive buoyancy thus enabling displacement of the entire carrier.

8 Claims, 8 Drawing Figures

ARRANGEMENT FOR TRANSPORTING SOLID MATERIALS FROM THE BOTTOM OF BASINS

FIELD OF THE INVENTION

The invention relates to and sea mining, and more specifically, to an arrangement for transporting soil and other materials from the bottom of basins.

The invention may be most advantageously used in mining ores and, in particular, in mining ferromanganese concretions from the ocean bottom.

Another important field of application of the invention is underwater hydraulic engineering.

With the present state of technology, mining of ores at the sea and ocean bottom in a number of cases proves to be more effective than mining continental deposits. It is therefore obvious that the development and improvement of underwater mining technology and the proportion of minerals obtained from underwater deposits will continually grow because of the exhaustion of terrestrial deposits or increased difficulties encountered in their mining.

Recent investigations have shown that a number of deep-water regions of the abyssal part of the world's waters are promising for prospecting and mining of solid mineral deposits including ferromanganeze concretions.

The industrial mining of such deposits is not, however, possible without the provision of radically new, highly productive and efficient arrangements for transporting solid minerals from the ocean bottom.

DESCRIPTION OF THE PRIOR ART

At present, solid minerals extracted at the bottom by various devices are positively transported to a support vessel by means of submersible pumps, air-lift devices and mechanical means comprising an endless flexible carrier having buckets.

The use of submersible pumps at greater depths is limited because there are no powerful sealed electric motors available to drive such pumps.

An airlift device is being widely used which consists of a pipeline having compressed air supply nozzles arranged therealong so that solid minerals are entrained with the air from the bottom and are conveyed along the pipeline to a support vessel.

The airlift devices are, however, deficient because of low efficiency and high energy requirements for transportation of minerals in an air-water stream.

At present, a transporting system in wide use comprises an endless rope having buckets secured thereto. The rope is made of polyamide and is 40 mm in diameter with and ultimate tensile strength of 20 tons. In one experiment with such a system, the rope which was 8200 m long had 240 buckets secured thereto at 25 m spacing, each bucket containing 45 kg of concretion.

Also known in the art is an arrangement comprising an endless flexible carrier moving along a closed path along with a device for loading the carrier which is displaced along the bottom.

A common disadvantage of transporting arrangements of this type is in that their productivity, reliability and mining depth depend on the strength of the flexible carrier which makes the construction more complicated and results in increased manufacturing cost of the arrangement and higher power requirements for transportation of concretions.

SUMMARY OF THE INVENTION

It is an object of the invention to improve the efficiency of transportation of solid minerals from the bottom of basins.

Another object of the invention is to lower power requirements for transportation of solid minerals.

Still another object of the invention is to improve the reliability of arrangements for transporting solid minerals from the bottom of basins.

A further object of the invention is to simplify the construction of the arrangement for transporting solid minerals from the bottom of basins.

Finally, it is an object of the invention to improve the productivity of equipment for mining solid deposits at the bottom of basins.

These and other objects are accomplished by an arrangement for transporting soil from the bottom of basins comprising a flexible carrier having sections and means for loading the sections with soil and for unloading the soil when the sections emerge from the basin. According to the invention, eact section of the carrier comprises at least two chambers—a load chamber and a float chamber which is made of a gas—and waterproof material. Devices are provided for batched feeding to soil to the load chamber and for filling the float chamber with gas upon filling of the load chamber and for discharging the gas when the section emerges from the basin.

The arrangement according to the invention provides a material reduction of applied forces and power requirements for transportation of solid minerals from the bottom of basins.

The arrangement is structurally simple and ensures high productivity in transporting solid minerals. Thus, the mining cost of minerals is considerably lowered. The arrangement according to the invention enables an increase in mining depth of solid minerals to as much as 6000 m.

A casing of each carrier section may be latticed and have a latticed partition wall which divides the section into the load chamber and the float chamber, the float chamber comprising a tightly sealed shell which has its open portion secured to the partition wall.

This construction prevents solid minerals from getting in the float chamber during unloading on board support vessels and also prevents the gas from escaping from the float chamber during transportation of minerals.

BRIEF DESCRIPTION OF THE DRAWINGS

Other objects and advantages of the invention will become apparent from the following detailed description of a preferred embodiment thereof illustrated in the accompanying drawings, in which.

DETAILED DESCRIPTION OF THE INVENTION

Figure 1:
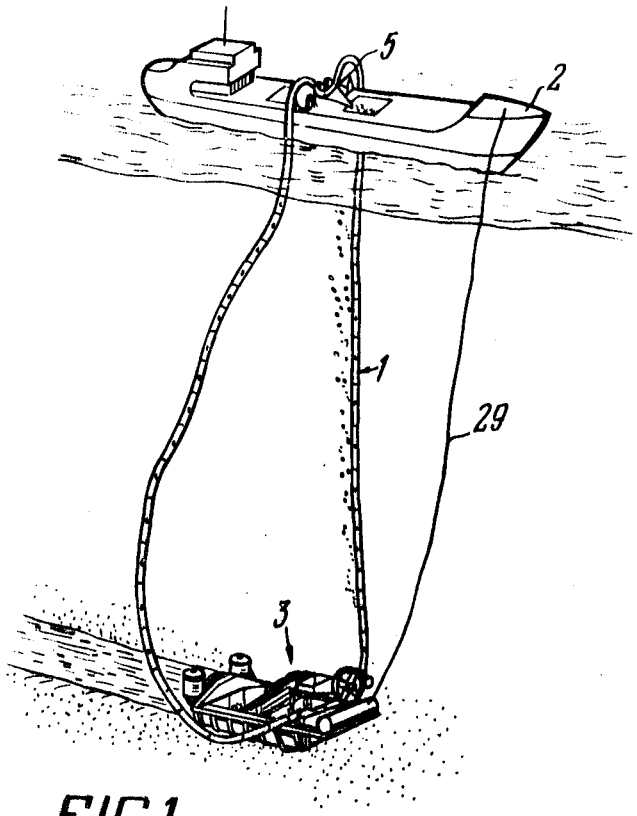
FIG. 1 is a general view showing the arrangement according to the invention.
Figure 2:
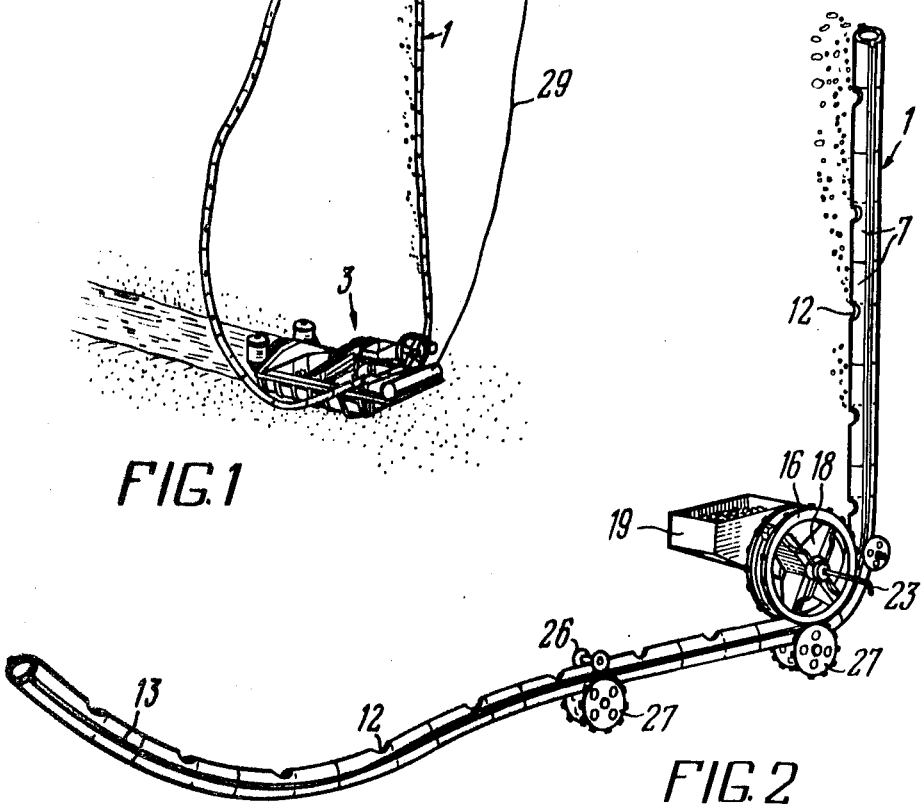
FIG. 2 is a perspective view of the means for loading soil into the sections of the flexible carrier.

The arrangement comprises an endless flexible carrier 1, (FIGS. 1–5) which is attached to a support vessel 2, and means 3 for loading into the carrier 1 solid mineral 4 preliminarily extracted from the ocean bottom by means of a mining implement (not shown). In addition, means 5 for unloading the carrier 1 is installed on board the support vessel 2.

Figure 4:
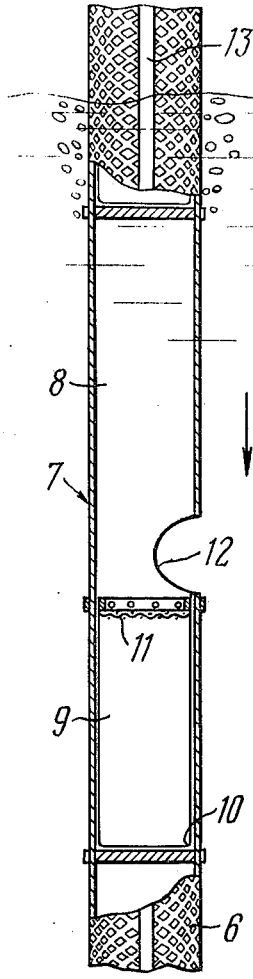
FIG. 4 is a sectional view of the carrier section at the moment of immersion in the basin.
Figure 5:
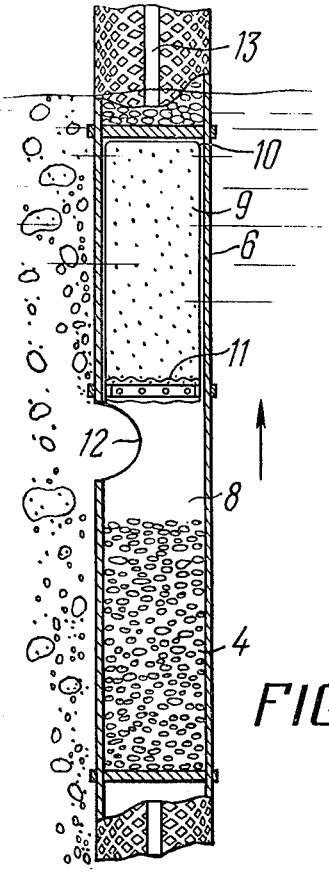
FIG. 5 is a sectional view of the carrier section at the moment of emergence from the basin.
Figure 3:
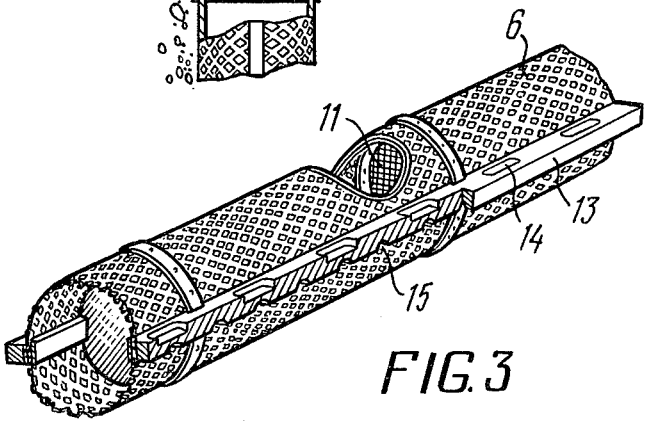
FIG. 3 is a perspective view of the flexible carrier section.
Figure 7:
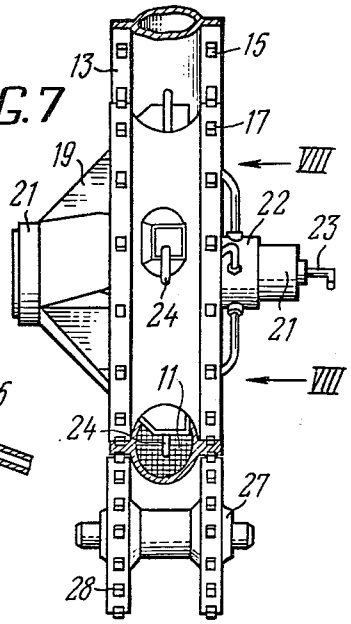
FIG. 7 is a view taken in the direction of the arrow A in FIG. 6.

The flexible carrier 1 has a casing 6 in the form of a hose made of a metal or synthetic network and divided into container sections 7 (FIGS. 4–5). Each section 7 comprises two chambers—a load chamber 8 for receiving a batch of solid mineral and a float chamber 9 having a tightly sealed shell 10. The open part of the shell 10 is secured to a latticed partition wall 11 which separates the chambers 8 and 9. Each section 7 has an opening 12 for loading a batch of solid minerals 4.

The casing 6 of the carrier 1 is provided with guide ribs 13 extending generally longitudinally along opposite sides thereof which have perforations 14 15 (FIG. 3) at different spacings. The means 3 (FIG. 1) for batched supply of minerals 4 to the sections 7 of the carrier 1 comprises a drum 16 having teeth 17 engaging the perforations 14 of the ribs 13. The drum 16 has radially extending chambers 18 having their inlet openings (not shown) aligned with an outlet opening (not shown) of a hopper 19 containing the mineral 4 during rotation of the drum 16 and outlet openings 20 aligned with the loading openings 12 of the sections 7. It will be apparent that the spacing of the outlet openings 20 of the chambers 18 should be equal to the spacing of the openings 12 of the sections 7.

Figure 8:
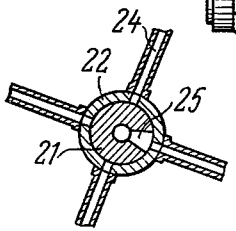
FIG. 8 is a cross-sectional view taken along the line VIII—VIII in FIG. 7.
Figure 6:
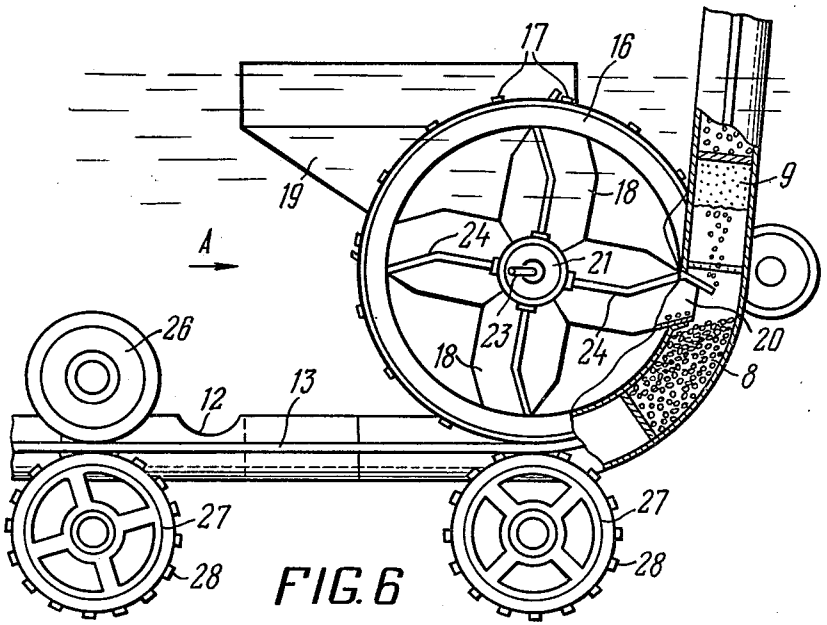
FIG. 6 is an enlarged elevational view, partly in section, of the means for batched feeding of soil and air to the carrier sections.

The drum 16 is rotated on an axle 21 (FIG. 8) which supports a distribution bushing 22 connected to an air line 23. For admission of compressed air to the float chamber 9 upon filling of the load chamber 8, each chamber 18 is provided with an air pipe 24 connected to the air line 23 via the distribution bushing 22 and a sectorial recess 25 of the axle 21.

The axle 21 of the drum 16 and the hopper 19 are supported by a frame (not shown) which may be mounted on the means 3 for loading the mineral.

Prior to the loading, the sections 7 of the carrier 1 pass through a guiding device comprising rollers 26 which urge the carrier 1 against support rolls 27 having their teeth 28 engaging the perforations 15 of the ribs 13. The rollers 26 and rolls 27 may be attached, e.g. to the means 3 for loading the sections 7 of the carrier 1 (the attachement of the rollers 26 and rolls 27 is not shown in the drawings).

The arrangement also has electric power and compressed air supply sources (not shown) which may be located either on the support vessel with the energy supply via a cable 29 or on the means for extracting and loading the solid mineral.

The arrangement may be remotely controlled from the support bessel or it may be controlled automatically in accordance with a pre-set program.

Prior to the beginning of operation, the support vessel 2 transfers the arrangement to the region of extraction of the solid mineral 4, such as ferromanganese concretions. The means for extracting and loading concretions are installed at the bottom, and the carrier 1 is mounted in such a manner that the teeth 17 and 28 of the drum 16 and rolls 27, respectively, mesh with the perforations 14 and 15 of the ribs 13, respectively.

During operation, concretions 4 are fed to the hopper 19. During rotation of the drum 16 its chambers 18 are filled with concretions 4 one after another. When the chamber 8 passes under the drum 16 it communicates, via the opening 12, with the chamber 18 of the drum 16 and is filled with concretions 4. As the carrier 1 moves further around the drum 16, a batch of gas, such as hydrogen, oxygen or the like, is fed from an appropriate source (not shown) along the air line 23, via the distribution bushing 22 and air pipe 24, to the float chamber 9.

Air is admitted to the pipes 24 alternately upon their alignment with the sectorial recess 25, and the air volume is sufficient for partial filling of the tight shell 10 of the float chamber 9. The inner space of the tight shell 10 of the chamber 9 is completely filled during the ascendance of the sections 7 of the carrier 1 due to the gradual decrease in hydrostatic pressure of the surrounding water.

As the carrier 1 continues to ascend, excessive gas is exshausted from the chamber 9 through the loading opening 12.

Therefore, permanent positive buoyancy of the ascending run of the carrier 1 is ensured during operation of the arrangement so as to provide a traction force for displacement of the entire carrier 1. Upon lifting of the loaded sections 7 of the carrier 1 on board the support vessel 2, the means 5 effects the unloading thereof, and the partition wall 11 prevents the particles of the concretions 4 from the load chamber 8 from getting into the float chamber 9. Unloaded sections 7 of the carrier 1 are lowered under water and displaced to the means 3 for loading them. The descending run of the carrier 1 acquires a nearly zero buoyancy so that a very small force is required to displace empty sections 7 of the carrier 1 to the means 3 for loading them.

What is claimed is:

1. An apparatus for transporting solid material from the bottom of basins comprising: a flexible carrier having container sections, each section of said carrier including at least a load chamber and a float chamber, the float chamber being made of a gas and waterproof material; means for batched feeding of said solid material to a respective load chamber of a respective section; means for unloading said solid material from said respective load chamber upon emergence of said respective section from the basin; means for filling a respective float chamber of said respective section with gas upon filling of said respective load chamber with said solid material; and means for discharging the gas from said respective float chamber when said respective section emerges from the basin.

2. An apparatus according to claim 1, wherein a casing of each section is made of network material and is provided with a latticed partition wall which divides the section into the load chamber and float chamber, the float chamber comprising a tight shell having an open part secured to said partition wall.

3. An apparatus according to claim 1, wherein said carrier has longitudinal ribs and wherein said means for batched feeding comprises: a drum having teeth engaging perforations of said ribs of said carrier, said drum having radially extending chambers with outlet openings periodically in alignment with an opening of said load chamber of said respective section.

4. An apparatus according to claim 3, further comprising a hopper in which said solid material is stored after being extracted, an outlet of said hopper periodically in alignment with an inlet of each of said radially extending chambers of said drum.

5. An apparatus according to claim 3, wherein a casing of each section is made of a network material and is provided with a latticed partition wall which divides the section into the load chamber and float chamber, the float chamber comprising a tight shell having an open part secured to said partition wall.

6. Am apparatus according to claim 5, wherein said means for filling comprises a gas line mounted on said drum and being periodically in contact with said opening of said load chamber, the gas passing through said latticed partition wall to enter said float chamber of said respective section.

7. An apparatus according to claim 1, wherein said means for filling comprises a gas line mounted on said means for batch feeding and being periodically in contact with said respective section.

8. An apparatus according to claim 1, wherein said carrier is endless.

* * * * *